US006460618B1

(12) United States Patent
Braithwaite et al.

(10) Patent No.: US 6,460,618 B1
(45) Date of Patent: Oct. 8, 2002

(54) METHOD AND APPARATUS FOR IMPROVING THE PERMEABILITY IN AN EARTH FORMATION UTILIZING SHOCK WAVES

(75) Inventors: Stephen Richard Braithwaite, St. George (CA); Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/723,903

(22) Filed: Nov. 28, 2000

(30) Foreign Application Priority Data

Nov. 29, 1999 (EP) ..... 99204024

(51) Int. Cl.[7] ..... E21B 28/00; E21B 43/16
(52) U.S. Cl. ..... 166/249; 166/305.1; 166/177.2
(58) Field of Search ..... 166/249, 305.1, 166/63, 177.1, 177.2, 177.7

(56) References Cited

U.S. PATENT DOCUMENTS

| | | | | |
|---|---|---|---|---|
| RE23,381 E | | 6/1951 | Bodine, Jr. | |
| 3,422,760 A | * | 1/1969 | Mohaupt | 102/313 |
| 3,589,442 A | | 6/1971 | Kilgore | |
| 3,897,623 A | | 8/1975 | Tasaki et al. | |
| 3,951,458 A | * | 4/1976 | Cathles et al. | 299/13 |
| 4,049,056 A | * | 9/1977 | Godfrey | 166/177.5 |
| 4,345,650 A | * | 8/1982 | Wesley | 166/177.2 |
| 4,537,256 A | * | 8/1985 | Beard | 166/177.2 |
| 5,005,649 A | | 4/1991 | Smith et al. | |
| 5,069,307 A | * | 12/1991 | Katahara | 181/105 |
| 5,282,508 A | * | 2/1994 | Ellingsen et al. | 166/249 |
| 5,297,631 A | * | 3/1994 | Gipson | 166/299 |
| 5,396,955 A | * | 3/1995 | Howlett | 166/177.1 |
| 5,579,845 A | * | 12/1996 | Jansen et al. | 166/299 |
| 5,613,557 A | | 3/1997 | Blount et al. | |
| 5,836,393 A | | 11/1998 | Johnson | |
| 6,004,050 A | * | 12/1999 | Rehman et al. | 400/319 |
| 6,012,521 A | * | 1/2000 | Zunkel et al. | 166/177.1 |
| 6,186,228 B1 | * | 2/2001 | Wegener et al. | 166/177.2 |
| 6,250,388 B1 | * | 6/2001 | Carmi et al. | 166/249 |

FOREIGN PATENT DOCUMENTS

| | | |
|---|---|---|
| FR | 2337606 | 8/1977 |
| WO | 9802638 | 1/1998 |

OTHER PUBLICATIONS

International Search Report of Mar. 8, 2001.

* cited by examiner

*Primary Examiner*—David Bagnell
*Assistant Examiner*—Jennifer H Gay

(57) ABSTRACT

A method for improving the permeability of an earth formation zone surrounding a wellbore formed in the earth formation utilizing hydraulic shockwaves. The selected zone is isolated and fluid is pumped downhole to fracture the earth formation, the fluid extending into the fractures. A shock wave is then created in the fracturing fluid to reduce the presence of illite clays in the formation interstices.

6 Claims, 2 Drawing Sheets

34
36
36
36
36
36
36
36
26
24
30
18
32
28
46
42
44
40
38
14

34
48
36
36
48
48
36
36
48
48
36
36
36
24
26
47
30
32
46
28
42
44
40
38
14

36
36
36
36
36
36
36
26
24
49
30
32
51
54
28
52
62
51
60
58
64
56
56
50
55
14

METHOD AND APPARATUS FOR IMPROVING THE PERMEABILITY IN AN EARTH FORMATION UTILIZING SHOCK WAVES

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

Field of the Invention

The present invention relates to a method of improving the permeability of an earth formation zone surrounding a wellbore formed in the earth formation. In the practice of producing hydrocarbon fluid from an earth formation via a wellbore to a production facility at surface, a perforated casing or liner is generally installed in the wellbore. The hydrocarbon fluid flows via the pores of the formation towards the casing or liner and via the perforations thereof into the wellbore.

BRIEF SUMMARY OF THE INVENTION

A problem frequently encountered is that the permeability of the earth formation is relatively low resulting in reduced production capacity of the wellbore. One cause of such reduced permeability is the presence of formation illite in the pores-. Formation illite is a clay mineral which partially occupies the interstices between the rock particles. The presence of illite in the form of needles or platelets significantly reduces the ability of hydrocarbon fluid to flow through the pores.

It is an object of the invention to provide a method of improving the permeability of an earth formation zone surrounding a wellbore formed in the earth formation.

In accordance with the invention there is provided a method of improving the permeability of an earth formation zone surrounding a wellbore formed in the earth formation, the method comprising pumping a selected liquid via the wellbore into said earth formation zone so as to create a body of liquid extending into the wellbore and into the pores of said zone;

lowering a shock wave generator into the body of liquid in the wellbore; and inducing the shock wave generator to generate a shock wave in the body of liquid.

It is thereby achieved that the shock wave travels through the pores of the formation where the body of liquid is present and thereby destroys the illite particles present in the pores.

The invention will be described further in more detail and by way of example with reference to the accompanying drawings in which

BRIEF SUMMARY OF THE DRAWINGS

In the drawings like reference numerals relate to like components.

DETAILED DESCRIPTION OF THE PREFERRED EMBODIMENT

Figure 1:
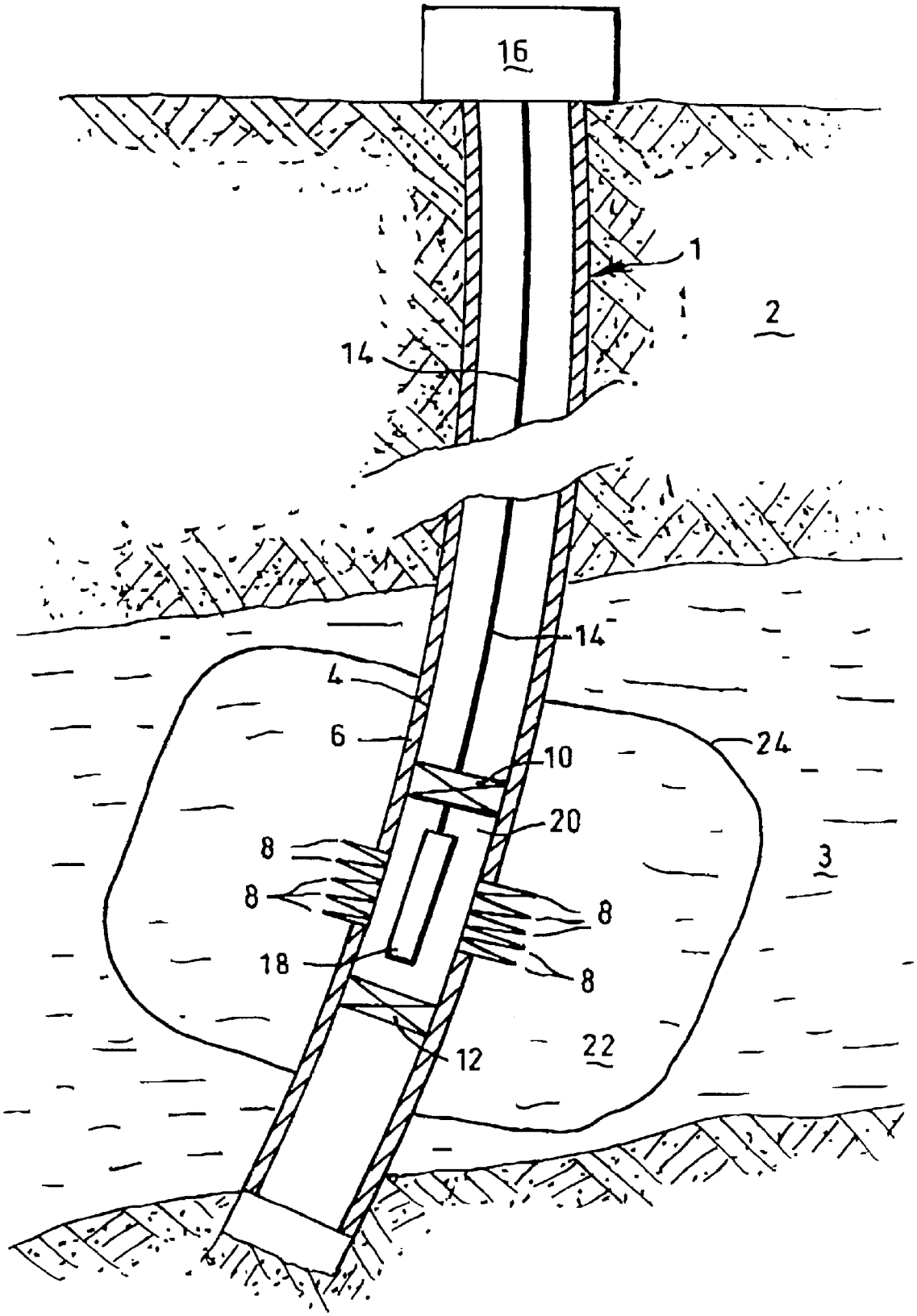
FIG. 1 schematically shows an embodiment of a wellbore used in applying the invention.

Referring to FIG. 1 there is shown a wellbore 1 formed in an earth formation 2 having a hydrocarbon fluid reservoir 3, the wellbore being provided with a casing 4 fixed in the wellbore 1 by a layer of cement 6. The casing 4 is provided with a plurality of perforations 8 at the level of the hydrocarbon fluid reservoir 3. An upper packer 10 is arranged in the casing above the perforations 8, and a lower packer 12 is arranged in the casing below the perforations 8. An electric cable 14 extends from a control facility 16 at surface through the casing 4 and through an opening (not shown) provided in the upper packer 10 to a shock wave generator 18 arranged in the space 20 between the packers 10, 12. The space 20 is filled with a body of brine 22 which extends via the perforations 8 into the hydrocarbon fluid reservoir 3 up to an interface 24 with the hydrocarbon fluid present in the hydrocarbon fluid reservoir 3.

Figure 2:
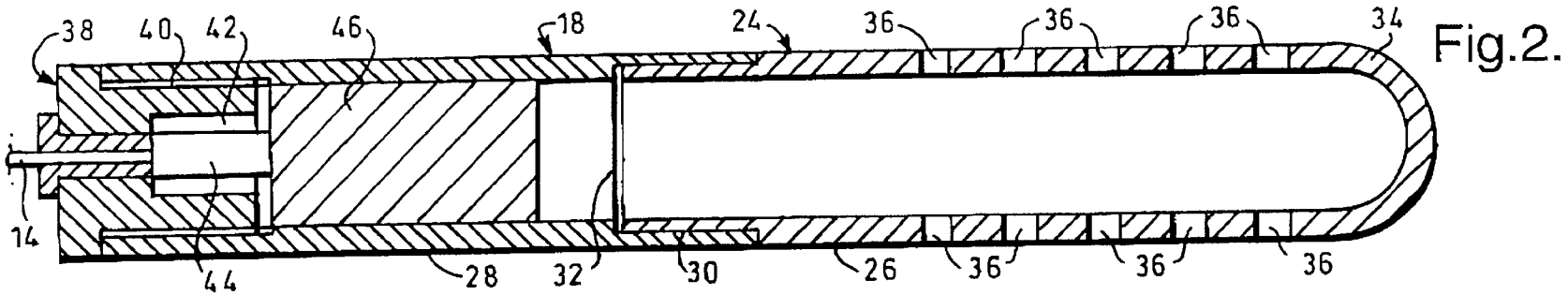
FIG. 2 schematically shows a device for use in the embodiment of FIG. 1.

In FIG. 2 is shown in more detail the shock wave generator 18 including a tubular housing 24 formed of a first tubular part 26 and a second tubular part 28 connected to the first tubular part 26 by a screw connection 30 whereby a shear disc 32 is biased between the first and second tubular parts 26, 28. The first tubular part is provided with an end cap 34 and a plurality of openings 36. The second tubular part is closed by a plug assembly 38 screwed in the second tubular part by means of screw connection 40. The plug assembly 38 is provided with a bore 42 in which an ignition device 44 connected to the electric cable 14, is arranged. A charge of deflagrating material 46 is arranged in the second tubular part 28, between the ignition device 44 and the shear disc 32.

Figure 3:
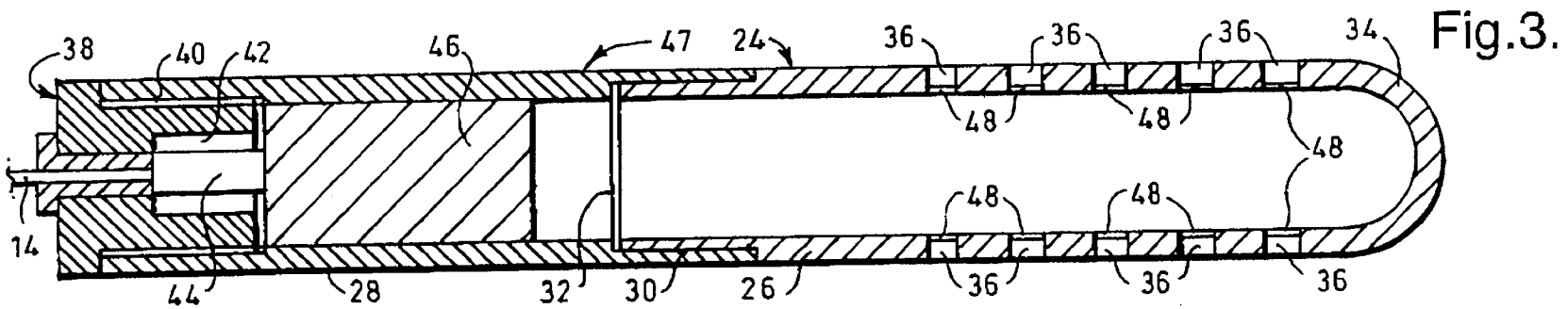
FIG. 3 schematically shows a first alternative device for use in the embodiment of FIG. 1.

In FIG. 3 is shown a first alternative shock wave generator 47 which is substantially similar to the embodiment of FIG. 2, the difference being that the shear disc 32 forms a primary shear disc and that each opening 36 is provided with a secondary shear disc 48.

Figure 4:
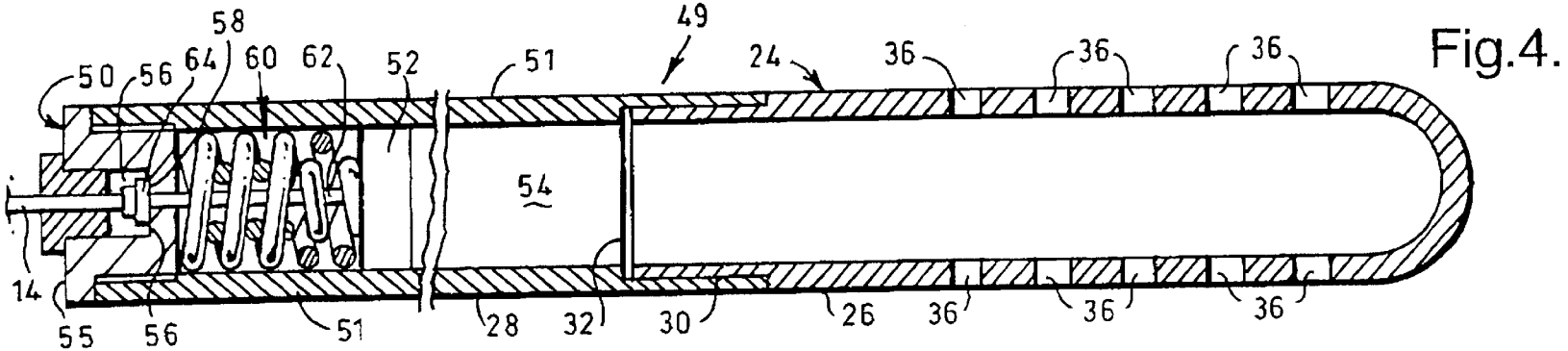
FIG. 4 schematically shows a second alternative device for use in the embodiment of FIG. 1.

In FIG. 4 is shown a second alternative shock wave generator 49 which is substantially similar to the embodiment of FIG. 2, except that the plug assembly, the ignition device and the deflagrating charge have been replaced by a piston assembly 50 including a cylinder 51 in the form of second tubular part 28 and a piston 52 arranged in the cylinder 51. The piston 52 is movable relative to the cylinder 51 in the direction of the shear disc 32 so as to compress a body of gas 54 present between the piston 52 and the shear disc 32. The piston assembly 50 furthermore includes a plug 55 screwed into the cylinder 51 and provided with a central bore 56 having an internal shoulder 58. A spring assembly 60 is arranged between the piston 52 and the plug 54, the spring assembly 60 being compressed by a threaded tie rod 62 at one end thereof connected to the piston 52 and at the other end thereof extending through the bore 56 and being retained at internal shoulder 58 by an explosive nut 64 connected to the electric cable 14.

During normal operation brine is pumped into the wellbore, the brine flowing via the perforations 8 into the hydrocarbon fluid reservoir 3. Pumping is stopped after a selected quantity of brine has flown into the hydrocarbon reservoir 3 so that the body of brine 22 is formed. Next the lower packer 12, the shock wave generator 18, the upper packer 10 and the electric cable 14 are installed in the wellbore 1.

The shock wave generator 18 (shown in FIG. 2) is then activated by transmitting a selected electric signal through the cable 14, which signal induces the charge of deflagrating material 46 to detonate. As a result the pressure in the second tubular part 28 rises to a level at which the shear disc 32 shears. Upon shearing of the shear disc 32, a shock wave occurs in the first tubular part 26 which travels through the openings 36 into the part of the body of liquid 22 present in the wellbore 1, and from there via the perforations 8 into the part of the body of liquid present in the hydrocarbon fluid reservoir 3. As the shock wave travels through the pores of the earth formation, the illite particles present in the pores are destroyed by the shock wave. This effect is even enhanced by reflection of the shock wave at the interface 24.

Normal operation using the first alternative shock wave generator 47 is similar to normal operation using the shock wave generator 18, except that additionally the secondary shear discs 48 are sheared off upon the occurrence of the shock wave in the first tubular part 26.

Normal operation using the second alternative shock wave generator 49 is similar to normal operation using the shock wave generator 18, except that the pressure rise in the second tubular part is now created by transmitting a controlled electric signal through the cable 14 in order to detonate the explosive nut 64. Upon detonation of the nut 64, the tie rod 62 breaks thereby inducing the spring assembly 60 to move the piston 52 in the direction of the shear disc 32 and to compress the body of gas 54. As a result the pressure in the second tubular part 28 rises to the level at which the shear disc 32 shears.

It will be appreciated that the shock wave generation characteristics of the embodiments of FIGS. 2, 3 and 4 are mutually different, therefore either of these embodiments can be selected in accordance with the required characteristics.

Any suitable water- and pressure proof deflagrating material can be selected for the charge of deflagrating material, for example RDX (1,3,5 Trinitro- 1,3,5 triazacyclohexane).

What is claimed is:

1. A method of improving the permeability of an earth formation zone surrounding a wellbore formed in the earth formation, the method comprising:

(a) isolating said earth formation zone from the remainder of the wellbore;

(b) pumping a selected liquid into say earth formation zone so as to create a body of liquid extending into the wellbore and into the pores of said earth formation zone, wherein said selected fluid is selected from water, brine or hydrocarbon fluid;

(c) lowering a shock wave generator into the body of liquid in the wellbore, the shockwave generator comprising a housing having a pressure chamber provided with means for generating a pressure increase in the pressure chamber, the housing being provided with at least one opening separated from the pressure chamber by at least one shear member;

(d) inducing the shock wave generator to generate a shock wave in the body of liquid; and (e) allowing an earth formation fluid to flow into the wellbore after induction of the shockwave in the body of liquid.

2. The shockwave generator of claim 1, wherein the means for generating a pressure increase comprises one of a charge of explosive material and a charge of deflagration material.

3. The shock wave generator of claim 2, wherein the housing is provided with a diffuser chamber separated from the pressure chamber by a shear disc, each said opening being provided in the wall of the diffuser chamber.

4. The shock wave generator of claim 3, wherein the means for generating a pressure increase comprises a cylinder and a piston movable relative to the cylinder in a direction so as to compress a body of gas present between the piston and the shear disc.

5. The shock wave generator of claim 4, further comprising spring means arranged to move the piston from a first position to a second position thereof so as to compress the body of gas, the piston being retained in the first position by a tie rod releasable by explosive activation.

6. The shock wave generator of claim 5, wherein said shear disc forms a primary shear disc, and wherein each said opening is provided with a secondary shear disc.

* * * * *